US006102810A

United States Patent [19]

Boland

[11] Patent Number: 6,102,810

[45] Date of Patent: Aug. 15, 2000

[54] WEIGHTED GOLF CLUB SHAFT AND HEAD COVER

[76] Inventor: William J. Boland, 414 Cedar St., Lake in the Hills, Ill. 60102

[21] Appl. No.: 09/220,176

[22] Filed: Dec. 23, 1998

[51] Int. Cl.[7] ..... A63B 69/36

[52] U.S. Cl. ..... 473/256; 150/160

[58] Field of Search ..... 473/256; 150/160

[56] References Cited

U.S. PATENT DOCUMENTS

| | | | |
|---|---|---|---|
| 2,676,803 | 4/1954 | Damaske | 473/256 |
| 2,737,394 | 3/1956 | Abel | 473/256 |
| 3,938,570 | 2/1976 | Stewart | 473/256 X |
| 5,284,194 | 2/1994 | Gaffney | 150/160 |
| 5,403,009 | 4/1995 | Gleason | 473/256 |
| 5,738,157 | 4/1998 | Gaffney | 150/160 |

*Primary Examiner*—George J. Marlo
*Attorney, Agent, or Firm*—Maksymonko & Slater

[57] ABSTRACT

A weighted cover for use on any one of a set of golf clubs. The cover including a foot to enclose the head of a golf club and to receive and rigidly retain a weight therein, the foot being of sufficient size to receive any golf club head of the set therein and a sheath connected to the foot that extends outwardly from the foot along the shaft of the club. The sheath being fabricated of an elastic material and defining a diameter less than that of a golf club head. The narrow diameter of the sheath maintaining the club head cover on the club and the length of the sheath serving to ornament and protect the golf club shaft. A strap affixed adjacent the point of connection of the sheath to facilitate further restriction of the diameter of the sheath and retention of the present cover during practice swinging thereof.

3 Claims, 1 Drawing Sheet

WEIGHTED GOLF CLUB SHAFT AND HEAD COVER

BACKGROUND OF THE INVENTION

The present invention relates generally to the game of golf and, more particularly, to golf clubs and head and shaft covers therefor. The present golf club cover functions in the conventional manner to protect the head of the club and to provide overall ornamentation on, and for, each club of the set. Beyond these well-known attributes, however, the present cover is further intended to effect protection for the shaft of the club itself—protection only imperfectly provided by known head covers.

Additionally, the present invention relates to the artificial weighting of an otherwise properly balanced club thereby increasing the weight of the head which, in turn, effectively converts an ordinary club into a 'heavy' practice club. Heavy clubs are known to be useful for golfer pre-game 'warm up', i.e. practice swinging, and serve as an alternative to the cumbersome, simultaneous gripping (and swinging) of multiple clubs—much like the baseball batter who, not infrequently, swings multiple bats while in the 'on-deck' circle. Several known examples of weighted head covers include Berrittella U.S. Pat. No. 2,116,655; Damaske, U.S. Pat. No. 2,676,803; Abel, U.S. Pat. No. 2,737,394; Rosenow, U.S. Pat. No. 3,145,749; Philippi, U.S. Pat. No. 4,213,614; Keelan, U.S. Pat. No. 5,294,127; and Gleason, U.S. Pat. No. 5,403,009.

The present cover is intended to provide an expedient solution to meet several objectives including protection of the head; protection of the club shaft adjacent the head (as set forth in more detail below); ornamentation of the club while in the golfer's bag; and, weighting to facilitate warm-up practice swinging. It will be appreciated that the cover disclosed herein may be provided for each club of the set or, more commonly to lessen the overall weight, a single weighted cover, preferably aesthetically matching the non-weighted covers of the other clubs, may be placed on a single club which weighted cover may, as required, be moved from club to club.

Changes in fabrication techniques and the materials used to fabricate, in particular golf club shafts, have led to the increased desirability of protecting, not just the head of the club, but the shafts as well. Many expensive clubs now employ graphite and other fiber-based, composite shaft materials and, as such, are generally more susceptible to scratching and similar damage than their metal-shafted forefathers. Understandably, the most vulnerable portion of the shaft is that region, immediately adjacent the head, which is inherently exposed both by reason of its extension above the club bag (while not 'in-use') as well as by reason of its not being 'wrapped' or otherwise covered by a rubberized gripping surface that defines the shaft 'handle'.

Although many of the head covers disclosed in the above-listed prior art do, in fact, facilitate weighted practice swinging, each suffers from one or more of the following shortcomings including aesthetically unattractive and displeasing appearance; clumsy to install and remove; expensive materials and fabrication; and/or, do not adequately protect the club head and shaft (in fact, may actively cause scratching thereof). For example, the hinged 'clam shell' arrangement of Berrittella '655 is believed to suffer from all of the above-listed maladies.

Philippi '614 exhibits similar limitations while Keelan '127 is only slightly better in that it is believed to snap into position. On the other hand, the fixed-size molding of Keelan clearly limits its 'universality'—multiple sizes would be required to permit use in connection with all clubs of a given set.

Gleason '009 is a comparatively modern entry, but not one offering shaft protection. Gleason's use of 'hook and loop' fasteners' to attach the weight creates dubious aesthetics with, more problematically, uncertain weight retention properties. The older Abel '394 cover is not amenable to the knitted fabrication and shaft protection of the instant invention and its snap-enclosed weight pocket renders it less suitable, economically, for mass production.

There are several known "zipper" models including Damaske '803 and Rosenow '749. Zippers are believed to be less desirable in today's market for numerous reasons including the likelihood of zipper-induced damage to the head and shaft, the cost of the zipper and its installation, and the current trend, aesthetically and otherwise, away from zippers.

The prior art universally teaches the desirability of closely conforming and attaching the head cover to the head, itself,—this, in order that the weighted portion of the cover may be retained in close, non-moving proximity to the head. This common sense approach was likely encouraged by the belief that a loose, moving weight might more readily detach itself from the club and, further, that a moving weight would be distracting or, at least, detrimental to the desired practice function of the club and head cover.

Against the asserted advantages of a tight-fitting, closely conforming head cover (and weight) come certain disadvantages previously outlined. Such disadvantages include the cost and complexity of fabricating a tight-fitting cover, for example, of the clam-shell Berrittella '655 variety, the snap-on Keelan '127 type, or the arguably convoluted installation and latching system taught by Philippi '614. These comparatively complicated covers are clearly less aesthetic and offer a substantially greater likelihood of damage/scratching to the club head and shaft. Even more significantly, these cover 'topologies' are simply not 'real' in that they do not look like or match existing ornamental and protective head covers. Such oddly-configured covers would look 'out-of-place' if added to a conventional set of covers. Lastly, by reason of their respective closely-conforming contours, each cover exhibits a limited range of club sizes onto which a given weighted cover can be fitted. This correspondingly limits the universality of the cover, in turn, requiring multiple covers to span the range of club sizes in connection with which such covers may reasonably be expected to be used.

Modern ornamental/protective covers (i.e. of the non-weighted variety) are generic in that, often, 'one-size-fits-all'. The weighted head cover described herein is adapted to meet this trend in ornamental head covers whereby a single weighted head cover not only fits any club, but physically, is identical or similar to the non-weighted covers such that it does not stand out as a misfit among the clubs. Thus, it will be appreciated that the present head cover departs from the convention wisdom that such covers must tightly conform to the club head and implements a design that facilitates 'one-size-fits-all' and 'all-look-the-same'.

To these ends, the present head cover employs a single-sized head enclosure or boot which may be fabricated of any conventional material including leather, fabric or it may be knitted. In view of the foregoing, it will be understood that this enclosure will preferably be of sufficient inside dimension and volume to receive any club head of the set as well as the 'weight' to be added as set forth in more detail below.

The head boot defines a sealed or completely enclosed form except for a comparatively small opening at one end through which the club head, itself, must pass.

To achieve shaft protection, an elongated, narrow cylindrical sheath is sewn or otherwise affixed to the boot at its opening. This sheath may be as much as twelve inches or more in overall length and serves to receive the shaft therethrough. In this manner, a substantial length of the adjoining club shaft is protected by the sheath as the present weighted head cover is positioned over the club head.

More specifically, it is preferable that the sheath be fabricated of an elastic, knitted, or other 'stretchable' material so that the sheath can be deformed or 'stretched' while it is urged over the head (onto the club) but, importantly, whereby it returns to its comparatively narrow diameter once positioned on the adjoining club shaft. In this way the sheath acts not merely to protect the club, but as a 'first line of defense' to retain the weighted boot, attached thereto, on the club. A not-insignificant installation force, in short, is thereby required and, importantly, serves this retention function. Further, the tight-fitting nature of the sheath presents a favorable aesthetic appearance.

While an excessively long sheath is not an absolute requirement in connection with the present invention, it will be appreciated that the longer the sheath, the more club shaft protection is afforded while increasing the inherent cover retention resistance associated with such a tight-fitting elongated sheath. A strap or cord, positioned generally at the interface between the boot and sheath, is provided to 'cinch-in' the sheath adjacent the head thereby further assuring retention of the weighted head cover on the club during use.

A variety of weight-adding materials may be employed. Preferably a thin sheet of lead (e.g. ⅛") provides sufficient weight while minimizing the overall volume required. The sheet may be positioned anywhere within the boot, but is preferably sewn into a protective pocket along the bottom surface of the boot whereby the lead will be positioned adjacent the bottom of the club, but will be insulated from, and therefore will not scratch, the head during installation and use of the cover.

It is therefore an object of the present invention to provide a weighted head cover for pre-game/pre-stroke practice swinging. It is a further object that the cover shall be aesthetically pleasing whereby it may match or be similar in appearance to a set of non-weighted ornamental/protective golf club head covers. It is an object of the present invention that the weighted cover shall be positionable on any club of the set, that one-size-fits-all without the necessity of fabricating multiple covers for the various clubs in the set. It is a further object that the weighted cover not damage, mar or scratch the club head or the club shaft and, further, that it provide both ornamentation as well as club head and club shaft protection for the club in addition to its weighting, practice swing function.

Various other objects and advantages of the invention will hereinafter become more fully apparent from the following description of the embodiments and the drawings wherein:

DESCRIPTION OF THE PREFERRED EMBODIMENT

Figure 1:
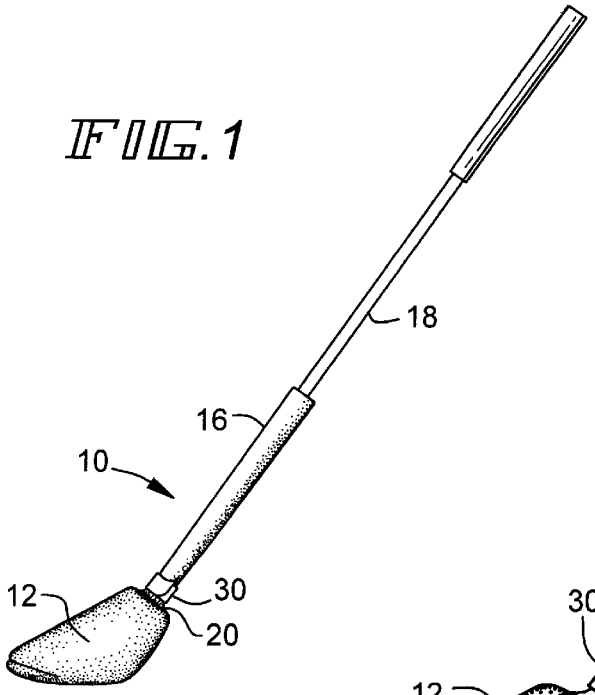
FIG. 1 is a front elevation view of the weighted golf club head cover of the present invention shown installed onto a golf club.

FIG. 1 best illustrates the overall finished appearance of a preferred embodiment of the present golf club head cover 10. As outlined above, cover 10 serves multiple functional objectives including the protection of both club head and shaft; providing an aesthetic appearance and ornamentation preferably matching a given head cover design; and, by its placement on the head, facilitating weighted practice club swinging.

Aesthetically, cover 10 is designed to be largely indistinguishable from, i.e. it is to 'match', the remainder of the 'ordinary', non-weighted covers of the club set. To this end it is preferable that cover 10 follow, to the greatest extent possible, the outward appearance and design of the covers in connection with which the present cover is intended to become a member. It will be appreciated as set forth in more detail hereinafter, however, that reliable retention of the weighted cover (i.e. during practice swinging) imposes certain structural constraints and therefore not every ornamental implementation may be suitable as a cover 10 of the present invention.

The cover 10 depicted in FIG. 1, however, closely follows the ornamental aspects of known covers while implementing the structural necessities of the present invention to assure cover/weight retention.

More specifically, cover 10 includes a bag-like foot 12 that completely surrounds and encloses a club head 14 (FIG. 2) and a sheath 16, rigidly attached to foot 12, that extends outwardly therefrom and along the shaft 18 of the club. Although not constrained by dimensions or otherwise to be so positioned, ordinarily, as will become clearer hereinafter, the 'interface' or point of rigid interconnection 20 between foot 12 and sheath 16 will be aligned and corresponds to the nominal junction between club head and shaft, 14 and 18 respectively.

Foot 12 may be fabricated from any convenient material including leather, cloth or knitted fabric, or, in the present case, a carpet-like, fuzzy-surfaced pliable fabric that imparts a pleasant soft feel and appearance to the completed cover 10. Again, the specific material may generally be chosen in accordance with other, non-functional design considerations although it will be understood that the material must have sufficient intrinsic strength and integrity so that it will not tear nor disintegrate, thereby losing the weight 22 held therein, during repeated club swings, including the occasional and inevitable 'ground' contact occasioned by the imperfect swing of the amateur golfer.

Foot 12 need not be critically dimensioned as previously thought and taught. While it remains desirable, if not preferable, to retain the added practice swinging weight 22 in rigid, fixed proximity to the club head, it has been determined that such a tight constraint is not required. More importantly, to require this artificial proximity militates against the objectives of the present invention (1) to 'imitate', ornamentally, the other head covers (most head covers are inherently loose-fitting); and, (2) to facilitate a 'one-size-fits-all' arrangement where a single weighted head cover 10 may be 'swapped' and fitted to any club of the set thereby allowing the golfer to select any club with which to practice.

Figure 2:
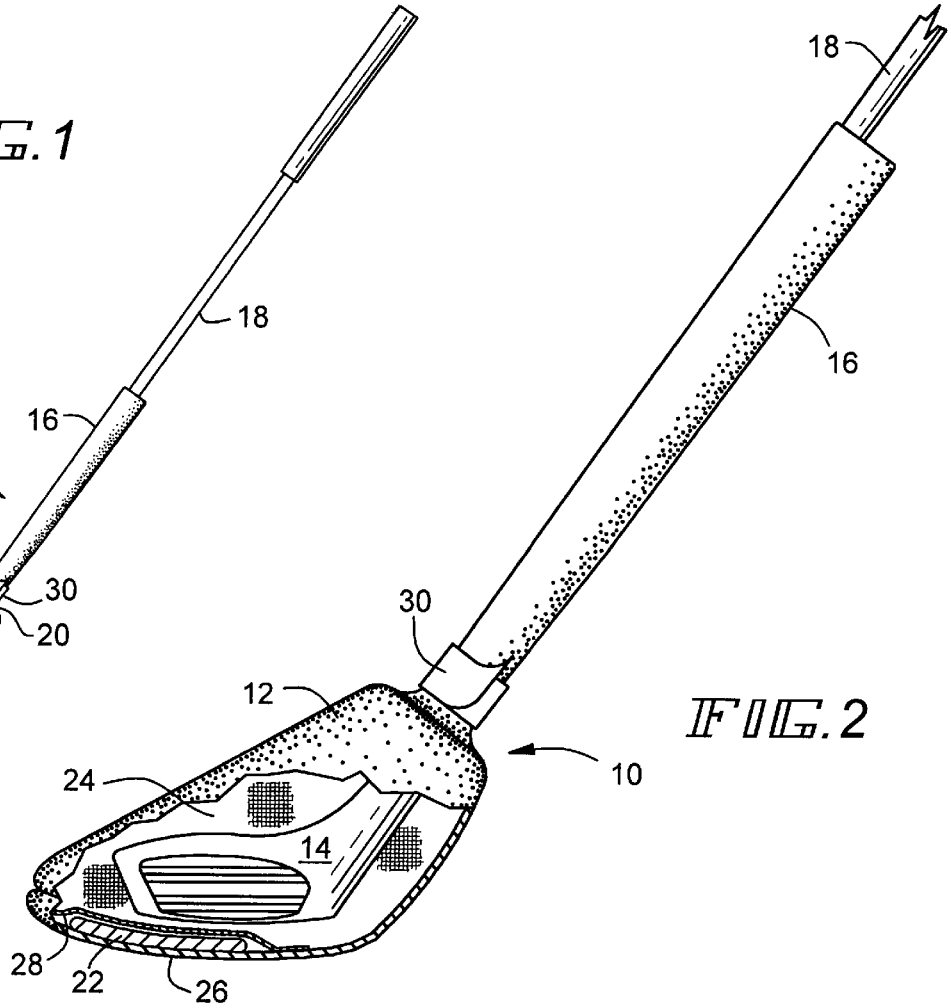
FIG. 2 is the front elevation view of the weighted golf club head cover of FIG. 1 with portions broken away and portions shown in section along line 2—2 of FIG. 3; and, FIG. 3 is a top plan view of the weighted golf club head cover of FIG. 1.
Figure 3:
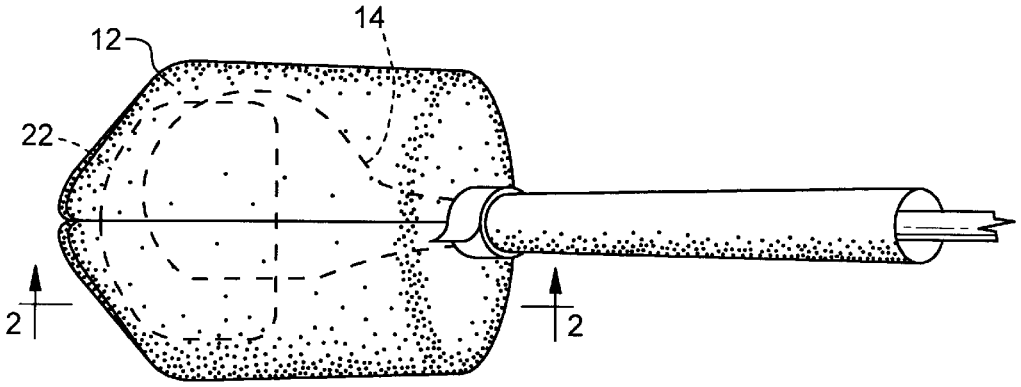

In this connection, FIG. 2 reveals the more typical relationship between club head 14 as it 'resides' within foot 12; namely, that the volume defined by, and within, the interior of foot 12 is greater than the corresponding size or volume of the club head 14 placed therein. This 'typical relationship', in turn, leaves and defines an 'unoccupied' space or gap 24 between the head and foot which, it must again be urged, is not required, but is permitted, by the present invention. Alternatively, depending on—or sacrificing—matters relating to the above-described ornamental conformity, foot 12 may be otherwise dimensioned to 'just receive' the largest club head 14 of the set, thereby reducing gap 24 to, effectively, "zero" size. Even as thusly (and somewhat arbitrarily and artificially) dimensioned, it will be apparent that the weight 22 will not be tightly held or forced into proximity with the club head 14 in the general case—that where other, smaller-dimensioned clubs of the set are utilized with the present head cover 10, a gap 24 will necessarily be found.

Still referring to FIG. 2, weight 22 can be seen positioned along, and laying flatly against, the lower or bottom surface 26 of cover 10. The weight may be of any size and shape and material, but preferably a flat sheet of lead of ⅛" thickness is employed. Lead of this thickness weights approximately 4 lbs/ft$^2$. It has been found that five ounces of lead, which corresponds to approximately 11 square inches of the above-noted sheet material, is sufficient to properly "weight" a practice club. The weight 22 may be retained flat against the inside of the lower surface 26 by adding, for example, of a piece of fabric 28 above the weight, which fabric is sewn around its periphery to thereby define an enclosed weight-holding pocket. This pocket-forming fabric 28 need not be of the same material nor strength as that of the foot 12, itself, by reason that the centrifugal forces generated during each swing are directed outwardly, generally urging the weight into tighter contact with the foot, and, further, that any wear occasioned by the inadvertent striking of the ground will be wear against the bottom, e.g. at lower surface 26, of the foot itself. Thus, comparatively little stress is placed on the inner fabric piece 28.

Foot 12 preferably includes a single aperture through which the club shaft 18 is permitted to 'exit' (i.e. from the boot portion of cover 10) and onto which the previously noted sheath 16 is sewn or otherwise rigidly affixed. More specifically, this aperture, in combination with sheath 16, define a channel through which the club head 14 must pass upon 'installation' of the present head cover 10 onto any given club and through which the club shaft 18 must be positioned, i.e. protrude, when the head cover 10 is thusly installed on the club.

As outlined extensively above, sheath 16 serves several important functions. First, it 'conforms' aesthetically with, and to, the other purely ornamental head covers comprising a set thereof. It will be appreciated, however, that the sheath's existence extends well beyond its mere aesthetic appeal. It is functionally required in order to achieve the remaining non-aesthetic objectives of the present invention.

The first of these non-aesthetic objectives relates to the protection of the club shaft 18. Graphite and similar composite shaft constructions are more susceptible to scratching and damage than their metallic counterparts. The sheath 16 of the present invention is therefore extended a substantial distance along the shaft to effect the desired protection, often, in the order of 12 inches or more.

It is readily apparent that the sheath 16 will provide positive shaft protection in the region, adjacent the club head 14, along which the sheath actually extends, i.e. its 12 inch length. What is less apparent is that the sheath may provide protection beyond its literal existence, i.e. to portions of the shaft not directly covered by the sheath. This 'extended' region of protection arises by reason of the inherent 'spacer' function of the sheath 16 whereby the active region of the sheath serves to space or 'buffer' adjacent clubs thereby lowering the probability of damaging contact. Thus, while a longer sheath may offer a higher degree of protection, it is not necessary that the full length of the unprotected portion of the shaft be covered by the sheath.

Secondly, in a preferred embodiment of the invention, the sheath serves and/or aids the rigid retention of cover 10 on the club during the practice swinging thereof. In this capacity the sheath 16 must be of generally cylindrical form and define a diameter less than the effective cross-sectional diameter of the club head 14. When this comparative size relationship is met the centrifugal force, acting on weight 22 to 'pull' the cover 10 free from the club, will be resisted by the head 14 which, in turn, imparts a force of equal but opposite magnitude against the narrow diameter sheath 16 to maintain cover 10 on the club.

Yet the sheath 16 cannot be of rigid or fixed cross-section as it must 'give' or stretch to admit passage of the club head 14 into the foot 12 of the cover, i.e. during the positioning thereof on a club. To this end, sheath 16 is preferably elastic, or of a material that exhibits elastic-like properties. More specifically, a preferred material or fabrication approach is that of knitting. Certain knitting stitches produce a longitudinal rib-like pattern (i.e. similar to a sock) that exhibits transverse elasticity, i.e. elasticity as the diameter of the sheath is increased. Once the club head 14 has been forced, through human action, into the foot 12 of the cover, the knitted sheath 16 substantially returns to its narrow diameter which, as discussed, effectively locks the cover 10 onto the club. It will be understood that other elastic-like material may be employed or, alternatively, added to an otherwise non-elastic sheath to impart the required stretch and 'return' properties.

In another embodiment of the present invention, a separate 'diameter constricting' lace, tie, or strap 30 may be employed either separately or in combination with the above-described elastic sheath to assure proper retention of cover 10 on the club. FIGS. 1 and 2 depict a Velcro-type loop and hook fastener and strap 30 sewn at one end thereof to sheath 16 generally in the region, or adjacent to, the intersection 20 between the sheath and boot. The strap is cinched tight around the sheath and secured, again, by its hoop and hook fastener to thereby guaranty that cover 10 cannot be forced from the club head during even the most energetic and forceful swing. It will be understood that other fasteners (e.g. snaps) may be employed consistent with the present invention and, further, that alternative means for cinching (i.e. restricting the diameter of the sheath) may be employed including, for example, laces or ties.

While the preferred embodiments have been described, various alternative embodiments may be utilized within the scope of the invention which is limited only by the following claims and their equivalents.

I claim:

1. A weighted cover for use on any club of a set of golf clubs including foot means for substantially surrounding the head of a club; the foot means defining an interior volume of sufficient size to receive the head of any club of the set whereby a gap between the foot means and club head shall be defined for at least all clubs having heads thereon that are smaller than the head of the largest club of the set; the foot means further including an aperture through which a club head may pass to admit the club head to the interior volume thereof and from which the shaft of a club shall extend when the cover of the present invention is positioned on a golf club; elongated generally cylindrical sheath means for ornamentizing and protecting the shaft of a golf club, the sheath means defining a channel through its interior having openings at opposed ends thereof, means for attaching one end of the sheath means to the foot means proximal to the aperture whereby the head of a golf club enters the foot means by passing through the full length of the sheath, the sheath means being fabricated of elastic material and having a diameter less than the cross-sectional area of a golf club head whereby the sheath means expands to admit passage of the head into the foot means and contracts after passage whereby the again narrowed diameter of the contracted sheath means resists movement and removal of the head cover during practice swinging thereof; weight means within the interior volume of the foot means; means for attaching the weight means to foot means whereby the weighted head cover facilitates warm-up practice swinging while the foot and sheath means serve to retain the weight and protect the club head and shaft in a manner aesthetically consistent with other non-weighted head covers.

2. The weighted cover of claim 1 including means for restricting the cross-sectional size of the foot means aperture whereby the cover is maintained on the club head during the practice swinging thereof.

3. The weighted cover of claim 2 in which the restricting means includes strap means attached to said one end of the sheath means and means for tightening the strap means whereby the diameter of said sheath means channel may be restricted.

* * * * *